US005649479A

United States Patent [19]

Hoffman

[11] Patent Number: 5,649,479

[45] Date of Patent: Jul. 22, 1997

[54] INK RECOVERY DEVICE

[75] Inventor: Richard Hoffman, St. Charles, Ill.

[73] Assignee: M & R Printing Equipment, Inc., Glen Ellyn, Ill.

[21] Appl. No.: 322,826

[22] Filed: Oct. 13, 1994

[51] Int. Cl.[6] ..... B41L 27/00

[52] U.S. Cl. ..... 101/123; 101/114

[58] Field of Search ..... 101/123, 129, 101/127, 126, 125, 115, 114

[56] References Cited

U.S. PATENT DOCUMENTS

| | | | |
|---|---|---|---|
| 4,273,042 | 6/1981 | Machida | 101/115 |
| 5,022,320 | 6/1991 | Szarka | 101/127.1 |
| 5,201,452 | 4/1993 | Takahashi | 101/114 |
| 5,239,923 | 8/1993 | Belcher et al. | 101/115 |
| 5,245,922 | 9/1993 | Klemm | 101/126 |
| 5,275,098 | 1/1994 | Larson | 101/114 |

FOREIGN PATENT DOCUMENTS

| | | | |
|---|---|---|---|
| 1002828 | 4/1977 | Canada | 101/123 |

*Primary Examiner*—Edgar S. Burr
*Assistant Examiner*—Anthony H. Nguyen
*Attorney, Agent, or Firm*—Wallenstein & Wagner, Ltd.

[57] ABSTRACT

A device for recovering accumulated ink from a screen in a printing press, the screen having interstices corresponding to printed indicia, the device comprising means for applying the screen with ink while travelling along the length of the screen in a first direction, first means for generating a signal when said ink applying means has reached a desired point of travel after printing, means for stopping travel of said ink applying means in response to said signal from said first signal generating means, second means for generating a signal when recovery of ink is desired, and means for permitting further travel of said ink applying means in response to said signal generated by said second signal generating means, and lowering said ink applying means.

5 Claims, 1 Drawing Sheet

INK RECOVERY DEVICE

TECHNICAL FIELD

The present invention relates to the field of screen printing. More specifically, the present invention relates to a device for automatic recovery of an accumulation of ink in a screen printing press.

BACKGROUND OF THE INVENTION

Fanciful indicia can be printed on clothing or any other suitable substrate. The indicia is typically printed on an article or substrate through a screen. The screen has interstices which correspond to the indicia to be printed. If it is desired to print using several colors, a series of screens is used, each screen corresponding to one of the particular colors.

Some of the inks used to print the indicia are liquid-based, typically water or plastisol. Other inks are also used, such as those containing solvents and those which are cured using ultraviolet light. These types of inks are conventional in the art. Methods for printing indicia using these inks are also well-known in the art. Typical in the industry is use of a print head comprising a flood bar and a squeegee for printing. The flood bar floods the screen with ink as the print head moves in a first direction towards the front of the screen, and the squeegee squeezes the ink through the interstices in the screen and onto the article to be printed as the print head moves in a second direction towards the rear of the screen. There are several different types of printing press, including a clam shell-type, a turret-type, and others. Some applications do not use a squeegee.

During printing, there is a tendency for ink to accumulate at one end of the screen. To remedy this, an operator of the press must stop operation of the printing press to manually scrape the accumulated ink back onto the printing area of the screen. This is time-consuming and results in down time in the operation of the machine, resulting in lost productivity.

A need has existed for a device which eliminates the manual scraping of the ink onto the printing area of the screen. The present invention eliminates the need for the operator to stop the machine and manually recover ink accumulated at the end of the screen, thereby increasing productivity and reducing down time.

SUMMARY OF THE INVENTION

It is an object of the present invention to provide a screen printing ink recovery device. In accordance with the invention, the device comprises means for applying the screen with ink while travelling along the length of the screen in a first direction, first means for generating a signal when said ink applying means has reached a desired point of travel after printing, means for stopping said ink applying means in response to said signal from said first signal generating means, second means for generating a signal when recovery of ink is desired, and means for permitting further travel of said ink applying means in response to said signal generated by said second signal generating means, and lowering said ink applying means.

An object of the present invention is to provide a device for ink recovery to prevent the operator of a printing press from having to stop operation to manually remove ink accumulated at the rear of the screen. Another object of the present invention is to decrease down time of operation of a printing press, thereby increasing productivity.

Other advantages and aspects of the invention will become apparent upon making reference to the specification, claims and drawings to follow.

DETAILED DESCRIPTION OF THE PREFERRED EMBODIMENT

Figure 1:
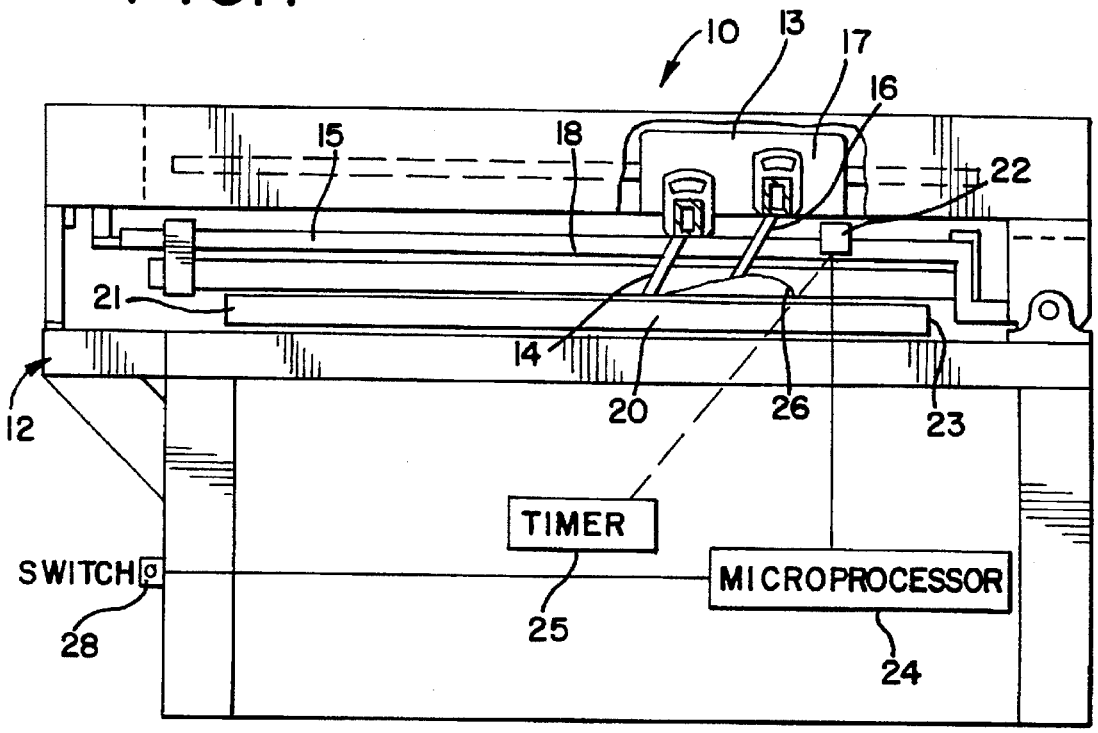
FIG. 1 is a schematic view of the ink recovery device of the present invention.

While this invention is susceptible of embodiment in many different forms, there is shown in the drawings and will herein be described in detail a preferred embodiment of the invention with the understanding that the present disclosure is to be considered as an exemplification of the principles of the invention, and is not intended to limit the broad aspect of the invention to the embodiment illustrated.

Referring to the drawings, the ink recovery device of the present invention is denoted by reference numeral 10. The device 10 comprises a screen printing press 12. The printing press 12 is of a conventional type in the art. The press 12 illustrated and described is known in the art as a clam shell-type press, but the present invention is intended to be adapted to be used with any type of screen printing press.

The clam-shell printing press 12 has a print head 13 comprising a squeegee 14 and a flood bar 16. It will be understood that some applications do not require a squeegee. The operation of the squeegee 14 and flood bar 16 are well-known in the art. The squeegee 14 and flood bar 16 ride along bars 18, which run parallel along the length of the press 12. The flood bar 16 and squeegee 14 are often pneumatically powered, but may be powered by any available means. The flood bar 16 floods a screen 20 with ink as the flood bar 16 travels in a first direction along the screen 20 (leftwardly as viewed in FIG. 1) to a designated first position 15, and the squeegee 14 squeezes the ink through the screen 20 onto an article to be printed as the squeegee 14 travels in a second direction, opposite the first direction, the flood bar 16 terminating at a second position 17. The space between the first and second positions 15 and 17 defines a print area. Movement in the first direction is referred to herein as the flood stroke, and movement in the second opposite direction is referred to herein as the print stroke.

The screen 20 has opposing ends 21 and 23. When the flood bar 16 is applying ink during the flood stroke, the flood bar 16 is in a lower position relative to the squeegee 14. On the return print stroke, the flood bar 16 is raised and the squeegee 14 is lowered to contact the screen 20. This operation is conventional in the art. A microprocessor 24 controls the operation of the flood bar 16 and squeegee 14. Alternatively, the length of travel of the print head 13 can by determined by a timer 25 or other appropriate means. The above-described use of an electronic control of the squeegee 14 and flood bar 16 during the flood stroke and print stroke is also conventional in the art.

A sensor 22 determines the extent of travel of the print head 13 during the flood stroke and print stroke. When the print head 13 reaches either the first position 15 or second position 17, the sensor 22 signals the microprocessor 24, operatively engaged with the print head 13 and programmed to stop its travel upon receipt of such signal. The sensor 22 can be placed along the length of the press 12 depending, for example, on the size of the screen 20. The sensor 22 is a proximity switch. The microprocessor 24 may be of any type suitable for the application. A timer 25 may also be used to generate signals to determine the length of the print stroke. During the timed period, the print head moves the desired distance. The longer the period, the greater the distance moved. Use of timers is known in the art.

Figure 2:
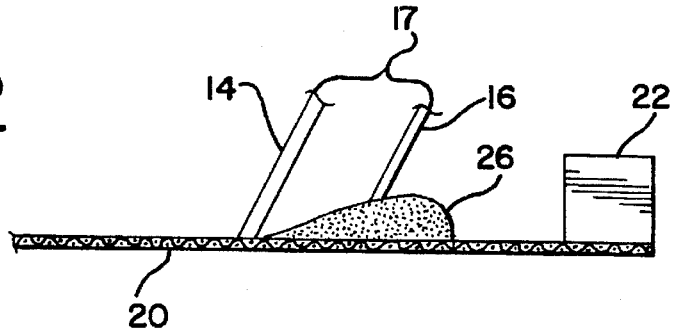
FIG. 2 is a side view of the squeegee and flood bar prior to its recovering ink.
Figure 3:
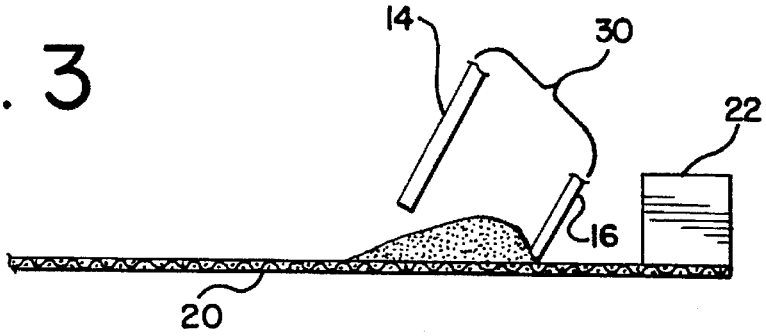
FIG. 3 is a side view of the squeegee and flood bar during ink recovery.

After the print stroke is completed, the flood bar 16 changes from a raised to a lowered position. (See FIGS. 2 and 3.) The initiation of the lowering of the flood bar 16 is controlled by the microprocessor 24 in response to the signal generated by the sensor 22. This lowering of the flood bar 16 typically takes on the order of 0.5 seconds, depending on the air pressure in the pneumatic power moving the flood bar 16 and squeegee 14. This lowering time can be adjusted to suit the particular application.

Over time, during operation of the printing press 12, an accumulation 26 of ink gathers at the rear of the screen 20. To recover ink from the accumulation 26 of ink using the present invention, the operator presses a switch 28 which generates a signal to the microprocessor 24. The signal instructs the microprocessor 24 to permit the print head 13 to travel a desired distance greater than ordinarily permitted by sensor 22. This additional travel occurs during the adjustable time period described above wherein the flood bar 16 is lowered after it is stopped at the end of the print stroke in response to the proximity switch. This second time period can be adjusted as desired. After the flood bar 16 is lowered in preparation for the next print stroke, the additional travel of the print head 13 stops at a third position 30. The flood bar 16 is now behind the accumulation 26 of ink. (See FIG. 3.) As the flood bar 16 begins the next print stroke, it collects at least a portion of ink from the accumulation 26 and carries it over the screen 20. A timer 25 may also determine the amount of time during which the print head 13 additionally travels.

Alternatively, microprocessor 24 can be programmed to perform the above steps automatically after a preset number of print strokes, or switch between manual and automatic modes. This permits flexibility in the operation and relieves the operator of having to constantly check for accumulations 26 of ink. Programming a microprocessor to perform this task may be accomplished by any suitable program for the application.

While the specific embodiments have been illustrated and described, numerous modifications come to mind without significantly departing from the spirit of the invention, and the scope of protection is only limited by the scope of the accompanying claims.

What I claim is:

1. A device for recovering accumulated ink at an end of a screen in a printing press, the screen having interstices corresponding to printed indicia, the device comprising:

a. a print head comprising a squeegee and a flood bar, said flood bar applying ink to the screen while travelling along the length of the screen in a first direction;

b. first means for generating a signal when said print head has reached a desired point of travel after printing;

c. means for stopping travel of said print head in response to said signal from said first signal generating means;

d. second means for generating a signal when recovery of ink which has accumulated at an end of the screen is desired; and e. means responsive to said second means for generating a signal to lift said flood bar and move it past ink which has accumulated, and subsequently lower said flood bar after it has passed the accumulated ink to recover said ink as said flood bar is next moved in said first direction.

2. The ink recovery device of claim 1 wherein said travel stopping means comprises a microprocessor adapted to receive said signal from said first signal generating means and programmed to stop the travel of said print head.

3. The ink recovery device of claim 1 wherein said further travel permitting means comprises a microprocessor adapted to receive said signal from said second signal generating means, and programmed to permit further travel of said ink applying means while said print head is lowered.

4. The ink recovery device of claim 1 wherein said further travel permitting means comprises a timer adapted to permit further travel of said print head for a desired time.

5. The ink recovery device of claim 1 wherein said first signal generating means comprises a proximity switch.

* * * * *